United States Patent [19]

Nohmi

[11] Patent Number: 4,832,874

[45] Date of Patent: May 23, 1989

[54] METHOD OF SOLIDIFYING RADIOACTIVE WASTE AND SOLIDIFIED PRODUCT THEREOF

[75] Inventor: Mitsuhiko Nohmi, Tokyo, Japan

[73] Assignee: Ebara Corporation, Tokyo, Japan

[21] Appl. No.: 69,990

[22] Filed: Jul. 6, 1987

[30] Foreign Application Priority Data

Jul. 4, 1986 [JP] Japan ..... 61-155936

[51] Int. Cl.[4] ..... G21F 9/16

[52] U.S. Cl. ..... 252/628; 106/276; 106/DIG. 7; 106/273.1; 252/631

[58] Field of Search ..... 252/628, 631, 633; 106/DIG. 7, 273 R, 276, 277, 287.35; 264/DIG. 32; 210/751; 208/44, 39

[56] References Cited

U.S. PATENT DOCUMENTS

| | | | |
|---|---|---|---|
| 3,142,648 | 7/1964 | Lefillatre et al. | 252/628 |
| 3,298,961 | 1/1967 | Davis et al. | 252/631 |
| 4,021,363 | 5/1977 | Standart et al. | 252/628 |
| 4,119,560 | 10/1978 | Sheeline | 252/628 |
| 4,167,491 | 9/1979 | Gablin et al. | 252/628 |
| 4,204,974 | 5/1980 | Puthawala et al. | 252/628 |
| 4,246,233 | 1/1981 | Sheeline | 422/159 |
| 4,252,667 | 2/1981 | Stegmaier et al. | 252/628 |
| 4,460,499 | 7/1984 | Boden | 252/628 |
| 4,504,402 | 3/1985 | Chen et al. | 252/70 |
| 4,623,469 | 11/1986 | Conner | 210/751 |
| 4,663,086 | 5/1987 | Lefillatre | 252/628 |
| 4,702,862 | 10/1987 | Ledebrink | 252/628 |
| 4,710,266 | 12/1987 | Hayashi et al. | 159/7 |
| 4,725,383 | 2/1988 | Hayashi et al. | 252/629 |

FOREIGN PATENT DOCUMENTS

| | | |
|---|---|---|
| 10825 | 1/1976 | Japan . |
| 89799 | 7/1977 | Japan . |
| 23000 | 3/1978 | Japan . |
| 5429000 | 3/1979 | Japan . |
| 86100 | 7/1979 | Japan . |
| 10512 | 1/1980 | Japan . |
| 75699 | 6/1980 | Japan . |
| 95899 | 7/1980 | Japan . |
| 144600 | 11/1980 | Japan . |
| 152500 | 11/1980 | Japan . |
| 14195 | 2/1981 | Japan . |
| 14196 | 2/1981 | Japan . |
| 4880 | 2/1981 | Japan . |
| 132099 | 8/1982 | Japan . |

*Primary Examiner*—Howard J. Locker

*Attorney, Agent, or Firm*—Oblon, Fisher, Spivak, McClelland & Maier

[57] ABSTRACT

A radioactive waste that chiefly contains sodium sulfate or sodium borate as a solids content is blended with a mixture consisting of about 5–35 wt % of a low-molecular weight polyolefin and about 95–65 wt % of straight asphalt, and the resulting mix is processed into a solidified form. The solidified waste thus obtained has a softening point at least 20°–30° C. higher than the hertofore attainable values and exhibits good shape stability at elevated temperatures.

8 Claims, No Drawings

METHOD OF SOLIDIFYING RADIOACTIVE WASTE AND SOLIDIFIED PRODUCT THEREOF

BACKGROUND OF THE INVENTION

1. Field of the Invention

The present invention relates to a method of solidifying in aspect the radioactive waste originating from nuclear power plants and other atomic energy facilities, as well as to asphalt-solidified radioactive wastes that are attained by this method and which have improved shape stability at elevated temperatures. More particularly, the present invention relates to a method by which liquid waste from a nuclear reactor that is in the form of an aqueous solution containing sodium sulfate or sodium borate as a chief component is concentrated by evaporation and mixed with hot asphalt to solidify solid components contained in the liquid waste in asphalt, the method being characterized by using straight asphalt that has a predetermined amount of a low-molecular weight polyolefin incorporated therein. The asphalt-solidified solid components of liquid waste obtained by the method of the present invention has improved stability in shape at elevated temperatures.

2. Description of the Prior Art

Mixing radioactive wastes with asphalt and storing the resulting solidified product in repositories has already been commercialized as a method of waste management in nuclear reactors. According to this method, the liquid waste from a nuclear reactor is concentrated in an evaporator and further dehydrated into a solidified state while it is mixed with concentrate or asphalt. While various methods of disposal have been proposed, the most common technique used today is to lay up the solidified waste in an underground through in a limited area and covered on top with soil so that it is confined below the ground level.

The radioactive wastes can be solidified in asphalt include liquid radioactive wastes containing sodium sulfate or sodium borate, those containing suspended solids or various salts, laundry liquid wastes, and radioactive chemical sludges resulting from chemical presipitation treatments, spent ion-exchange resins, all of these originating from nuclear power plants, and sodium nitrate which originate from spent nuclear fuel reprocessing plants. In the case of boiling-water reactors (BWR), the liquid waste originating from the regeneration of ion-exchange resins at a condensate demineralizer, chiefly an aqueous solution of sodium sulfate, is to be solidified in asphalt. In the case of pressurized-water reactors (PWR), the liquid waste containing boric acid from primary coolant is to be solidified in asphalt.

The liquid wastes originating from BWR and PW are usually treated with two evaporators in tandem. The liquid waste from the BWR is concentrated to an aqueous solution of ca. 25% $Na_2SO_4$ in the first evaporator whereas the liquid waste from the PWR is concentrated to an aqueous solution of 10–12% sodium borate in the first evaporator. In either case, further concentration is not desirable since it will cause a trouble such as clogged pipes. The concentrated liquid waste is then fed into second evaporator in which it is mixed with asphalt while further evaporation of water is achieved. The mixture of asphalt and the dehydrated waste emerging from the second evaporator is compacted into a predetermined shape and cooled to solidify.

The volume of the BWR liquid waste that has been solidified by the method described above is approximately one quarter of the volume of the feed to the first evaporator, and about one sixth to one eighth in the case of the PWR liquid waste. If the same liquid waste were solidified in concrete, the volume of the final product would be approximately twice the volume of the feed to the first evaporator and this is independent of the type of reactor from which the liquid waste originates. Therefore, if reduction in volume were the only factor to be considered, asphalt would obviously be far better than concrete as a medium for solidifying the liquid waste.

However, as is well know, asphalt which generally has a considerable degree of hardness in cold climates such as in winter will become very soft at elevated temperatures such as in summer. Radioactive wastes in a solidified form desirably have a sufficient hardness to retain their shape even in hot climates such as in midsummer but it is difficult to meet this requirement by simply mixing the liquid waste with asphalt and solidifying the mixture. Because of this drawback, liquid wastes solidified in asphalt have heretofore been considered less stable at elevated temperatures than those solidified in concrete and the method of using asphalt as a solidifying medium has not gained much popularity. As a result of intensive studies conducted in order to solve these problems, the present inventors have successfully developed a method of solidifying radioactive wastes in asphalt that enables continuous mixing with asphalt to be accomplished easily in an evaporator and which provides an asphalt-solidified waste that is stable enough to retain its own shape even in hot climates such as in midsummer.

As already mentioned, mixing radioactive wastes with asphalt and storing the resulting solidified product in repositories is already in commercial practice and the asphalt employed in this method is the straight asphalt specified in JIS K 2207-1980. This straight asphalt has a softening point in the range of 30°–65° C. and an asphalt-solidified radioactive waste containing sodium sulfate or sodium borate in an amount of about 40 wt%, on solids basis, of the mixture has a softening point of about 68° C. as measured by the method specified in JIS K 2207. This asphalt-solified radioactive waste will gradually become fluid and deform if left at ambient temperature. In the current practice, such asphalt-solidified waste is put in a steel container for long-term storage but if holes are made in the container by corrosion or any other reason, the mixture of asphalt and radioactive waste can leak out to contaminate the environment.

SUMMARY OF THE INVENTION

An object of the present invention is to provide an asphalt-solidified radioactive waste that has such an increased softening point that it will not become fluid or otherwise deform even if it is stored at ambient temperature.

The term "softening point" as used herein should be construed as follows. Asphalt, when heated, undergoes a continuous change from the hard state to a soft or low-viscosity state without showing any clear-cut softening point. Therefore, a specific value obtained by a specific method of measurement is defined as the softening point of asphalt and the magnitude of this value is used as a measure of the ability of asphalt to withstand temperature elevation without experiencing any undesirable deformation.

According to the present invention, the following method specified in JIS K 2207 is used to determine the softening point of asphalt: molten asphalt is poured into a metal ring (outside diameter, 23 mm; thickness, 1.6 mm; depth, 6.4 mm); a steel ball (diameter, ca. 9.5 mm; weight, 3.5 g) is placed at the center of solidified asphalt; the ring is submerged in a water bath which is heated at a rate of 5° C./min; when the ball touches the bottom of a ring stand, the temperature of the water bath is measured to determine the softening point of the asphalt. The present inventors have found that the softening point thus determined of an asphalt-solidified radioactive waste produced by the method of the present invention is at least 20° C. higher than that of the same type of asphalt-solidified waste produced by the conventional method. The asphalt-solidified waste produced by the conventional method has a softening point of 68° C. (assuming the presence of 40 wt% sodium sulfate on a solids basis) or ca. 50° C. (in the presence of 40 wt% sodium borate). In contrast, the asphalt-solidified waste produced by the method of the present invention has a softening point of 93°-98° C. (40 wt% sodium sulfate) and 80°-85° C. (40 wt% sodium borate), indicating the increase of at least 30° C. above the corresponding values for the conventional product. It has also been confirmed that the asphalt-solidified waste produced by the method of the present invention has a needle penetration of 40-60, which is substantially equal to the value attained by the prior art product.

DETAILED DESCRIPTION OF THE INVENTION

The present invention relates to a method of solidifying a radioactive waste by incorporating it in asphalt to which has been added a small amount of a low-molecular weight polyolefin. The present invention also relates to a solidified radioactive waste that is produced by this method and which has increased shape stability at elevated temperatures. During the course of various studies conducted to solve the aforementioned problems of the prior art, the present inventors found that a radioactive waste that is solidified in asphalt to which a low-molecular weight polyolefin had been added had a higher softening point than the waste solidified in asphalt alone. The present invention has been accomplished on the basis of this finding.

The concentrate that is obtained by evaporating the liquid waste from a nuclear reactor in the first evaporator according to the prior art method is a hot aqueous solution consisting of ca. 25 wt% sodium sulfate and ca. 75 wt% water if the reactor is a BWR, and a hot aqueous solution consisting of 10-12 wt% sodium borate and 90-88 wt% water if the reactor is a PWR. This concentrate is fed into the second evaporator in which it is mixed with externally supplied asphalt (ca. 150° C.) and further evaporated to remove water. Since this operation is preferably performed continuously for attaining high efficiency, the asphalt to be fed into the second evaporator is straight asphalt which can be easily mixed with liquid radioactive waste. Blown asphalt would produce a solidified product having a higher softening point but at the same time, the mix of blown aphalt with liquid wastes has such a high viscosity that not only is it difficult to perform continuous mixing in the second evaporator but also a precipitate will form that can clog pipes. On the other hand, a radioactive waste as mixed with straight asphalt according to the prior art method has a softening point no higher than 68° C. and is not suitable for storage in hot climates as in midsummer.

It has, however, been found unexpectedly by the present inventors that straight asphalt to which a certain amount of a low-molecular weight polyolefin has been added can be easily mixed with a radioactive waste in the second evaporator and that the resulting solidified waste has a softening point which is at least about 20°-30° C. higher than the heretofore attainable value. The solidified waste produced by the present invention has improved stability during storage at elevated temperatures.

For various reasons such as the need to ensure easy mixing with asphalt, the polyolefin that is used in the practice of the present invention preferably has a molecular weight of no more than 2,000 and a melting point of no higher than 180° C., with the viscosity at a specific melting point being no more than 1,000 centipoises. The low-molecular weight polyolefin is preferably mixed with asphalt in an amount of 5-35 wt% of the resulting mixture. If the content of the polyolefin is more than 35 wt%, the final product will have an undesirably low flash point or fire pont. If the polyolefin content is less than 5 wt%, the intended shape-stabilizing effect of the polyolefin will not be attained. Preferably, the polyolefin is incorporated in asphalt in an amount of 5-20 wt% of the sum of the polyolefin and asphalt if the latter is to be mixed with a sodium borate containing waste. If the asphalt is to be mixed with a sodium sulfate containing waste, the intended effect will be exhibited by adding the polyolefin in an amount of at least 2 wt% on the same basis, with the range of 5-20 wt% being preferable.

From the viewpoints of effectiveness and availability, polyethylene and polypropylene are preferably used as the low-molecular weight polyolefin, with polyethylene being particularly preferred.

The straight asphalt that is commonly used and which has a needle penetration of 40-60 has a softening point in the range of 44°-53° C. If this asphalt is mixed with a radioactive waste containing 40% $Na_2SO_4$ on a solids basis, the finally solidified product will have a higher softening point of 65°-68° C. but this value is not high enough to permit the solidified product to be stored stably at ambient temperature without becoming fluid or otherwise deformed. However, if polyethylene wax having a molecular weight of 700-1,000 and a melting point of about 120° C. is mixed with asphalt in an amount of about 16.7 wt% of the sum weight of the asphalt and polyethylene wax, the softening point of the mixture is increased up to about 93° C., and the radioactive waste solidified in this mixture can be stored at ambient temperature without becoming fluid or otherwise deformed. It has been confirmed that the same results are attained if the polyethylene wax is replaced by a low-molecular weight polypropylene.

The following example is provided for the purpose of further illustrating the present invention but is no sense to be taken as limiting.

EXAMPLE

Six samples of straight asphalt were heated; two of them were mixed with a low-molecular weight polyethylene wax; two others were mixed with a low-molecular weight polypropylene wax; and the remainder were used as controls. These samples were further mixed with two different simulated wastes and the resulting mixtures were left to cool to solidify. The softening points of the solidified wastes were measured by the method specified in JIS K-2207. The compositions of the solidified wastes and their softening points and viscosities are shown in Table 1.

TABLE I

| straight asphalt (parts by weight) | Polyolefin additive (parts by weight) | Solids (parts by weight) | Softening point (°C.) | Viscosity |
|---|---|---|---|---|
| 60 | low-molecular weight polyethylene 0 | sodium sulfate 40 | 68 | 2,200 |
| 50 | low-molecular weight polyethylene 10 | sodium sulfate 40 | 93 | 600 |
| 40 | low-molecular weight polyethylene 20 | sodium sulfate 40 | 98 | 1,700 |
| 60 | low-molecular weight polyethylene 0 | sodium borate 40 | 49.5 | 1,500 |
| 50 | low-molecular weight polyethylene 10 | sodium borate 40 | 80.5 | 1,100 |
| 40 | low-molecular weight polypropylene 20 | sodium sulfate 40 | 84.5 | 1,400 |

The values of viscosity shown in Table 1 are in centipoises (cPs) and were obtained by measurement at 130° C. Each of the low-molecular weight polyethylene and polypropylene waxes was 15 cPs at 120° C. The straight asphalt used in the experiment had a needle penetration of 40–60. The low-molecular weight polyolefin was incorporated in an amount of 16.7% or 33.3% of the total weight of the mxiture of polyolefin and straight asphalt.

According to the present invention, a low-molecular weight polyolefin is added to asphalt used as a medium for solidifying radioactive wastes and the resulting solidified waste has such a high softening point that it can be stored at ambient temperatures without becoming fluid or otherwise deformed.

What is claimed is:

1. A method of solidifying a radioactive waste by first mixing it with asphalt to which a low-molecular weight polyethylene or polypropylene in an amount of 5–35 wt.% of the resulting mixture, that has a molecular weight of no more than 200 and a melting point of no higher than 180° C., with the viscosity at the melting point being no more than 1000 centipoises, has been added and processing the mixture into a solidified form.

2. A method according to claim 1, wherein the polyethylene has a molecular weight of no more than 2000 and a melting point of no higher 180° C., with the viscosity at the melting point being no more than 1000 centipoises.

3. A method according to claim 1 wherein the radioactive waste contains sodium sulfate or sodium borate.

4. A method according to claim 2 wherein the radioactive waste contains sodium sulfate or sodium borate.

5. A method according to claim 4 wherein the polyethylene is present in an amount of 5–20 wt% of the total weight of the mixture of polyethylene and asphalt.

6. An asphalt-solidified radioactive waste that is produced by a method according to claim 1.

7. An asphalt-solidified radioactive waste according to claim 6 wherein the asphalt is straight asphalt.

8. An asphalt-solidified radioactive waste according to claim 7 which contains sodium sulfate or sodium borate in an amount of 35–45 wt% on a solids basis.

* * * * *